US006023786A

United States Patent [19]

Burnett

[11] Patent Number: 6,023,786

[45] Date of Patent: Feb. 15, 2000

[54] JEWELRY COVERING DEVICE

[76] Inventor: Juanita Burnett, 245 Tampa St., Park Forrest, Ill. 60466

[21] Appl. No.: 09/062,928

[22] Filed: Apr. 20, 1998

[51] Int. Cl.[7] ..... A41D 19/02

[52] U.S. Cl. ..... 2/170; 2/16; 2/21; 2/910; 2/917; 63/15.8

[58] Field of Search ..... 2/16, 21, 162, 2/170, 338, 910, 917, 163, 158, 159, 160, 171; 63/12, 13, 21, 24, 15.8, 1.11; 132/273, 274, 275, 276; 602/60–62, 75; 604/385.2; D24/126

[56] References Cited

U.S. PATENT DOCUMENTS

| | | | |
|---|---|---|---|
| 3,921,221 | 11/1975 | Zoephel | 2/338 |
| 4,845,777 | 7/1989 | Mersinas | 2/21 |
| 4,896,378 | 1/1990 | Campana | 2/170 |
| 5,032,119 | 7/1991 | Hookano | 604/385.1 |
| 5,048,126 | 9/1991 | McLaughlin | 2/125 |
| 5,301,696 | 4/1994 | Revson | 132/273 |
| 5,456,274 | 10/1995 | Selbee et al. | 132/275 |
| 5,758,671 | 6/1998 | Thim | 132/273 |

*Primary Examiner*—Diana Oleksa
*Assistant Examiner*—Katherine Moran
*Attorney, Agent, or Firm*—Goldstein & Canino

[57] ABSTRACT

A jewelry cover, for selectively covering an article of jewelry present on a finger or wrist, comprising an outer cover having a first end, a second end, an inside, and an outside. A pair of elastic strips are stitched to the inside of the outer cover, and extend substantially between the first end and second end. A fastening device comprises a first fastener component and a second fastener component. The first fastener component is mounted at the first end on the outside of the outer cover. The second fastener component is mounted at the second end on the inside of the outer cover. The jewelry cover is selectively wrapped around the finger or wrist forming a loop thereabout, and the first fastener component and second fastener component are secured to each other to secure the jewelry cover thereto.

2 Claims, 5 Drawing Sheets

JEWELRY COVERING DEVICE

BACKGROUND OF THE INVENTION

The invention relates to a jewelry covering device. More particularly, the invention relates to a device which is wrapped around jewelry to effectively cover the jewelry while it is being worn, to protect the jewelry from damage, and to protect other objects from becoming scratched, damaged, or snagged by the jewelry while the wearer is engaged in certain activities.

A considerable amount of jewelry is either worn on the hand or on the wrist. Rings, bracelets, and watches are among the jewelry commonly worn on the hand or wrist. A great deal of this type jewelry is worn daily. Some people wear their jewelry everyday because of a special sentimental reason for doing so. Thus certain jewelry such as a wedding ring, engagement ring, or class ring is worn consistently, without exception. Others wear their jewelry everyday because they simply like the way it looks. Still other people wear their jewelry everyday because they have discovered that never removing their jewelry is one way to avoid misplacing it.

However, the problem with wearing jewelry everyday on the hand or wrist is that the jewelry can interfere with certain tasks and activities. For example, jewelry with slightly jagged edges can snag certain fabrics, such as stockings, drapery, etc. Also, jewelry can scratch delicate surfaces while cleaning or handling delicate objects. Further, the jewelry itself can become damaged if it contacts certain hard or abrasive surfaces. Still further, many people have been injured when their jewelry becomes caught in machinery.

Others have proposed various jewelry cases, which require that the user remove their jewelry before engaging in an activity in which the jewelry might become damaged, or cause damage. While these units may be suitable for the particular purpose employed, or for general use, they would not be as suitable for the purposes of the present invention as disclosed hereafter.

SUMMARY OF THE INVENTION

It is an object of the invention to produce a jewelry cover which effectively covers jewelry while it is being worn on a limb. Accordingly the invention provides a fabric covering which extends fully around the jewelry.

It is another object of the invention to provide a jewelry cover which is easily attachable around the jewelry, and then is easily removed therefrom. Accordingly, the fabric covering includes an outer cover comprising a fastening device having two components which are mounted on opposite ends of the outer cover, and the two components are also on opposite sides of the outer cover. The jewelry cover is wrapped around the jewelry, and the fastening components are engaged to secure the cover around the jewelry.

It is a further object of the invention to provide a jewelry cover that may selectively cover a ring on a finger, or a bracelet or watch on a wrist. Accordingly, the jewelry cover is sized differently to fit around either a wrist or a finger.

It is a still further object of the invention to provide a jewelry cover that is adaptable to cover fingers or wrists of different sizes. Accordingly, the jewelry cover is made with elastic material having a non-elastic cover fabric which has gathers for adjusting around different sized wrists or fingers.

The invention is a jewelry cover, for selectively covering an article of jewelry present on a finger or wrist, comprising an outer cover having a first end, a second end, an inside, and an outside. A pair of elastic strips are stitched to the inside of the outer cover, and extend substantially between the first end and second end. A fastening device comprises a first fastener component and a second fastener component. The first fastener component is mounted at the first end on the outside of the outer cover. The second fastener component is mounted at the second end on the inside of the outer cover. The jewelry cover is selectively wrapped around the finger or wrist forming a loop thereabout, and the first fastener component and second fastener component are secured to each other to secure the jewelry cover thereto.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
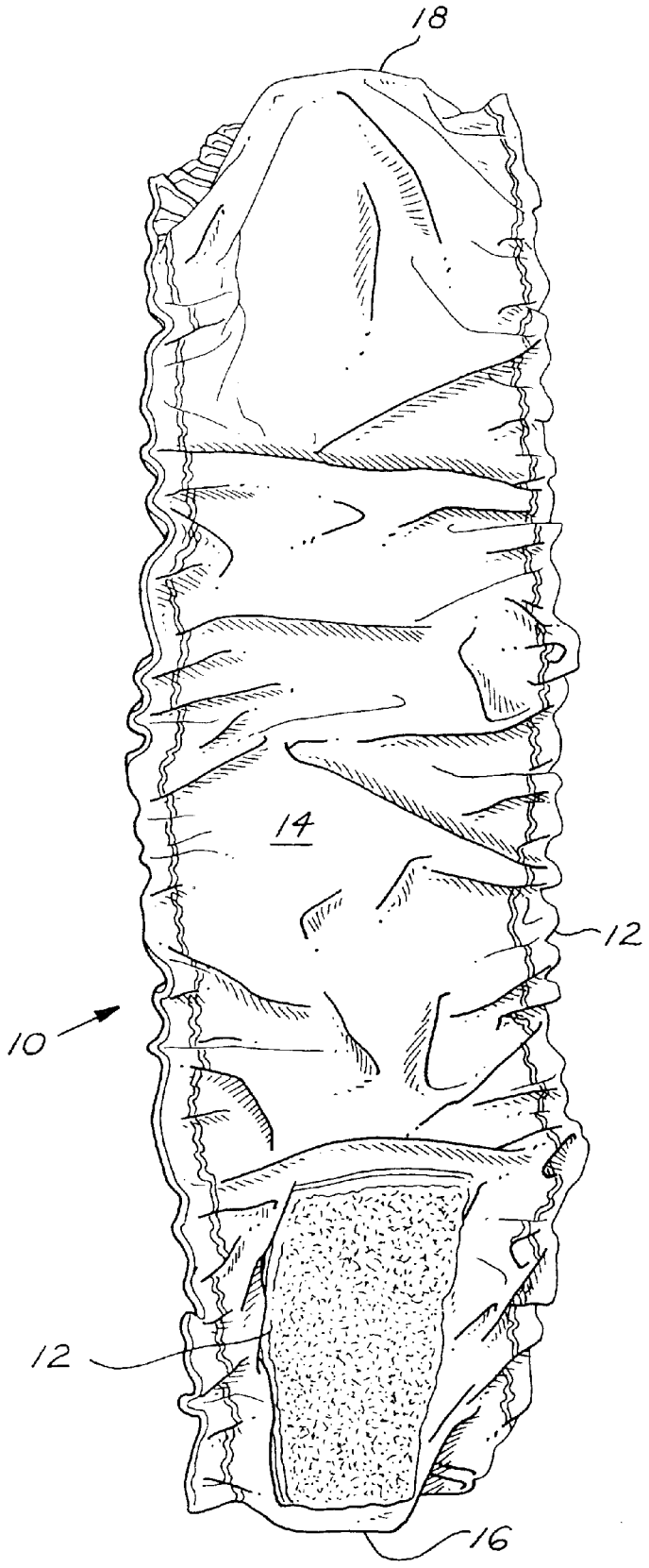
FIG. 1 is a top plan view, illustrating a jewelry cover as viewed from its outside.

FIG. 1 illustrates a jewelry cover 10, comprising a decorative outer cover 12, which is made of a non-elastic fabric, having an outside 14. The fabric is generally a thick, high quality material having a decorative appearance, such as a soft velvet-like material.

The jewelry cover 10 has a first end 16 and a second end 18 which are fully opposite each other. The jewelry cover 10 has a fastening device, comprising a first fastener component 12 located on the outside 14 at the first end 16.

Figure 2:
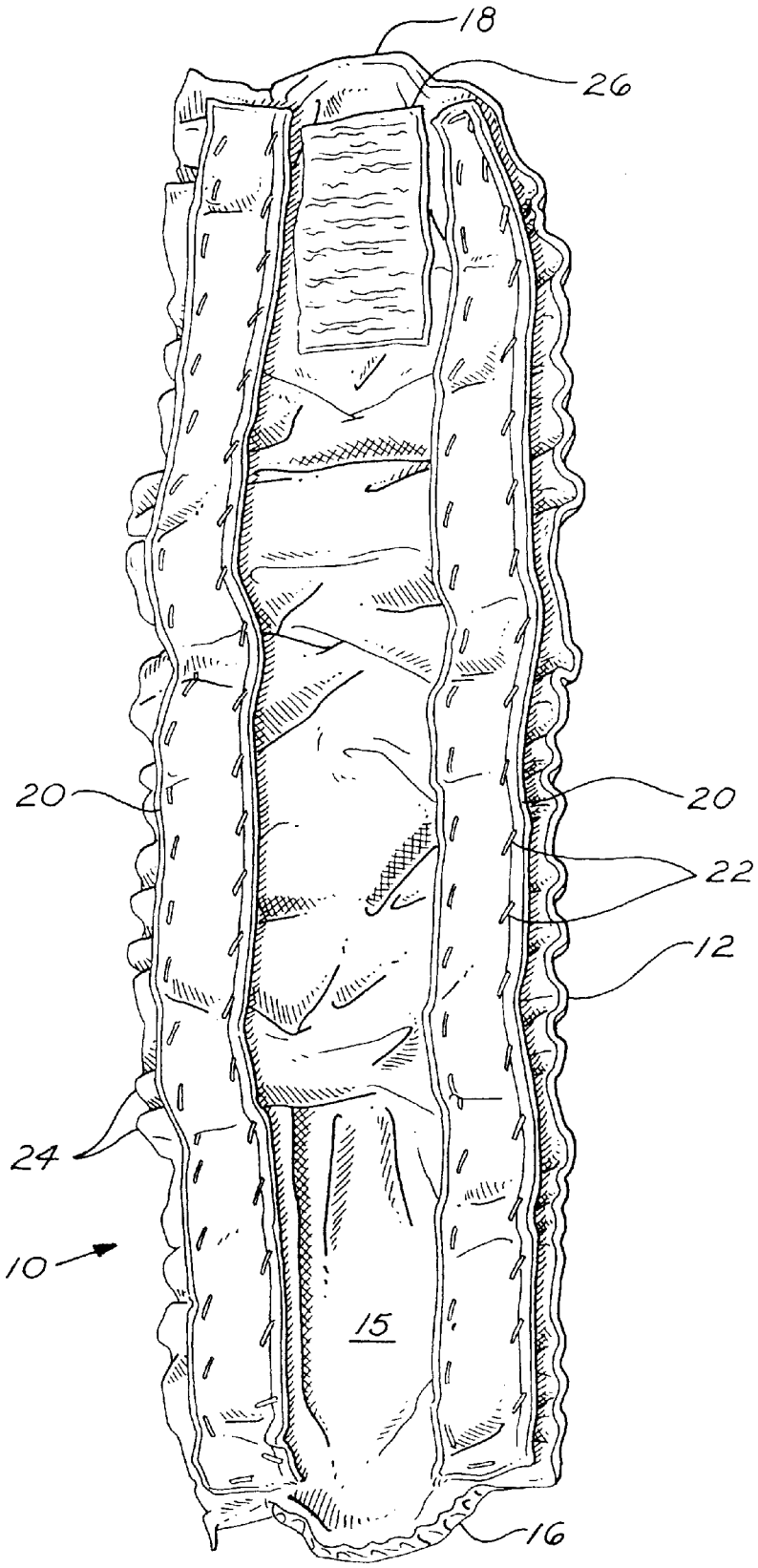
FIG. 2 is a bottom plan view, illustrating the jewelry cover as viewed from its inside.

FIG. 2 illustrates the jewelry cover 10 in bottom plan, wherein the jewelry cover 10 has an inside 15. The inside has a pair of elastic strips 20 mounted thereupon. The elastic strips 20 extend substantially between the first end 16 and second end 18.

The elastic strips 20 are attached to the outer cover 12 with stitching 22 which extends substantially between the first end and second end. The outer cover 12 has a plurality of gathers 24. The outer cover 12 is gathered when the unstretched elastic strips 20 are stitched to the outer cover 12. Thus, when the elastic strips 20 are stretched longitudinally, the outer cover 12, although itself non-elastic, can follow the elastic strips 20, expanding and contracting therewith.

The fastening device comprises a second fastener component 26 which is attached onto the inside 15 of the jewelry cover 10 at the second end 18, preferably between the elastic strips 20. The first fastener component 12 and the second fastener component 26 are thus located on opposite sides and at opposite ends from each other. The first fastener component 12 and second fastener component 26 are made to selectively engage to hold the jewelry cover 10 in a loop, and disengage to remove said jewelry cover 10. Thus the fastening device may be a snap assembly, or it may be hook and loop fastener material as illustrated herein.

Figure 3:
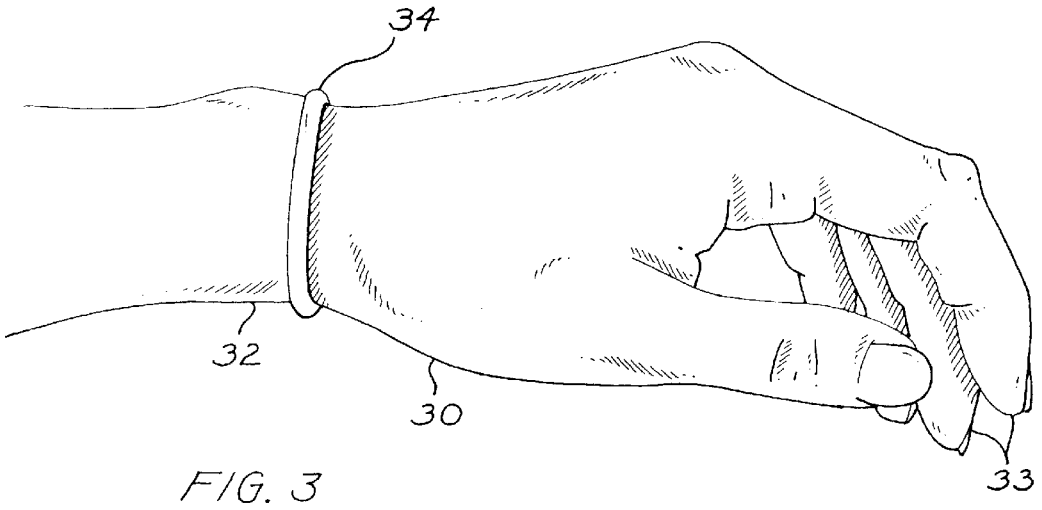
FIG. 3 is a side elevational view, illustrating a bracelet worn upon a wrist.
Figure 4:
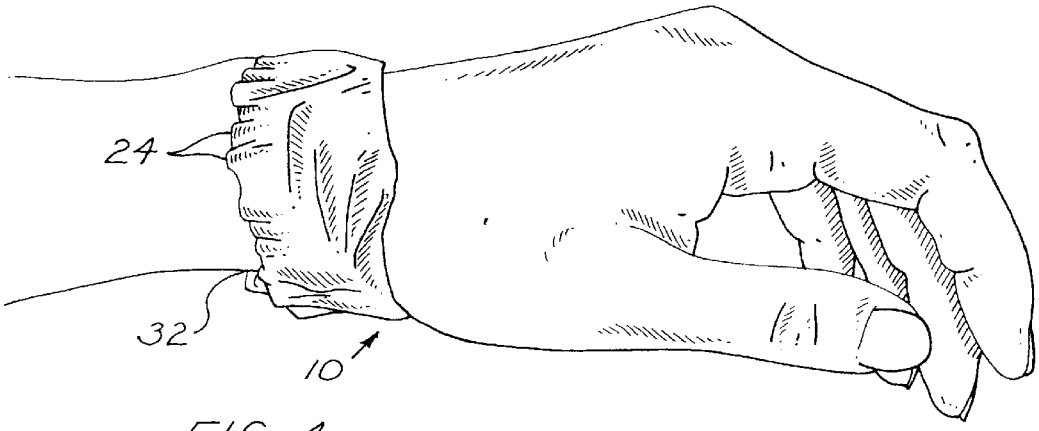
FIG. 4 is a side elevational view, similar to FIG. 3, except wherein the bracelet has been covered with the jewelry cover.

With reference to FIG. 3, a hand 30 is illustrated having a wrist 32, and a plurality of fingers 33. A bracelet 34 is attached around the wrist 32. With reference now to FIG. 4, the jewelry cover 10 has been attached around the wrist 32, covering the bracelet 34. The elastic strips and gathers 24 allow the jewelry cover 10 to adjust around the wrist 32, where it is held snugly by the fastening device, which maintains the jewelry cover 10 in a loop.

Figure 5:
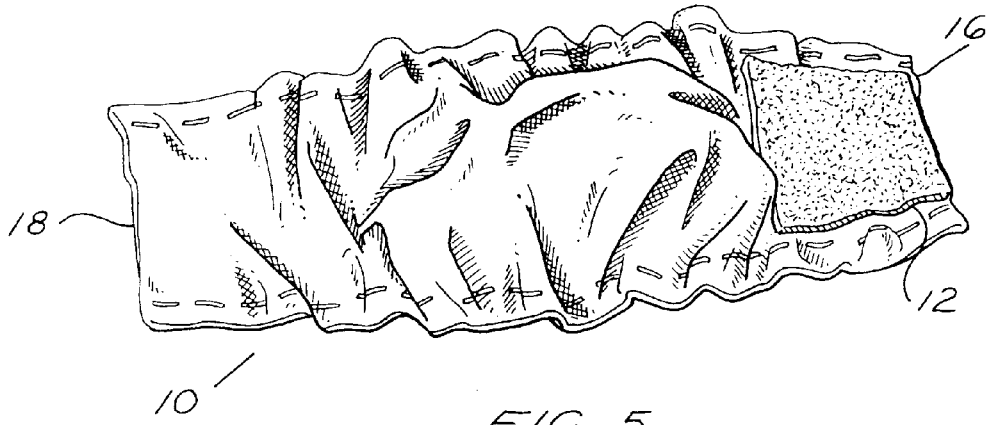
FIG. 5 is a top plan view of a second embodiment of the jewelry cover as viewed from its outside.
Figure 6:
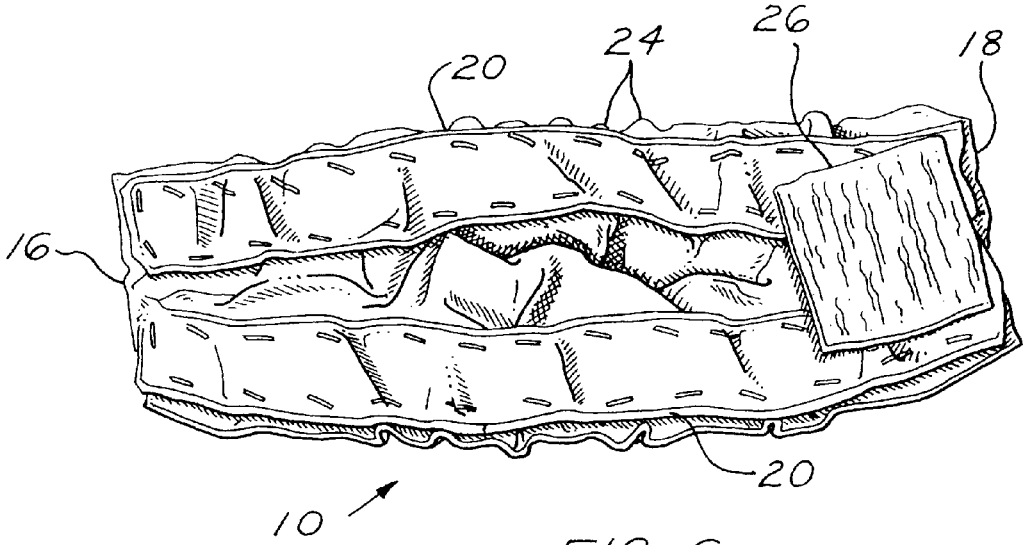
FIG. 6 is a bottom plan view of the second embodiment of the invention as viewed from its inside.

Referring now to FIG. 5 and FIG. 6, a second embodiment of the jewelry cover 10 is illustrated. The second embodiment of the jewelry cover 10 is configured to fit on a finger 33, to cover jewelry present thereon. Thus, the outer cover 12 is sized to be more stout than the version previously illustrated, which is intended for mounting on the wrist 32. The same principles of construction apply, wherein the elastic strips 20 extend substantially between the first end 16 and second end 18, the elastic strips 20 are stitched unstretched to the outer cover 12 with the gathers 24 in place, and wherein the first fastener component 12 and second fastener component 26 are on opposite sides and opposite ends from each other.

Figure 7:
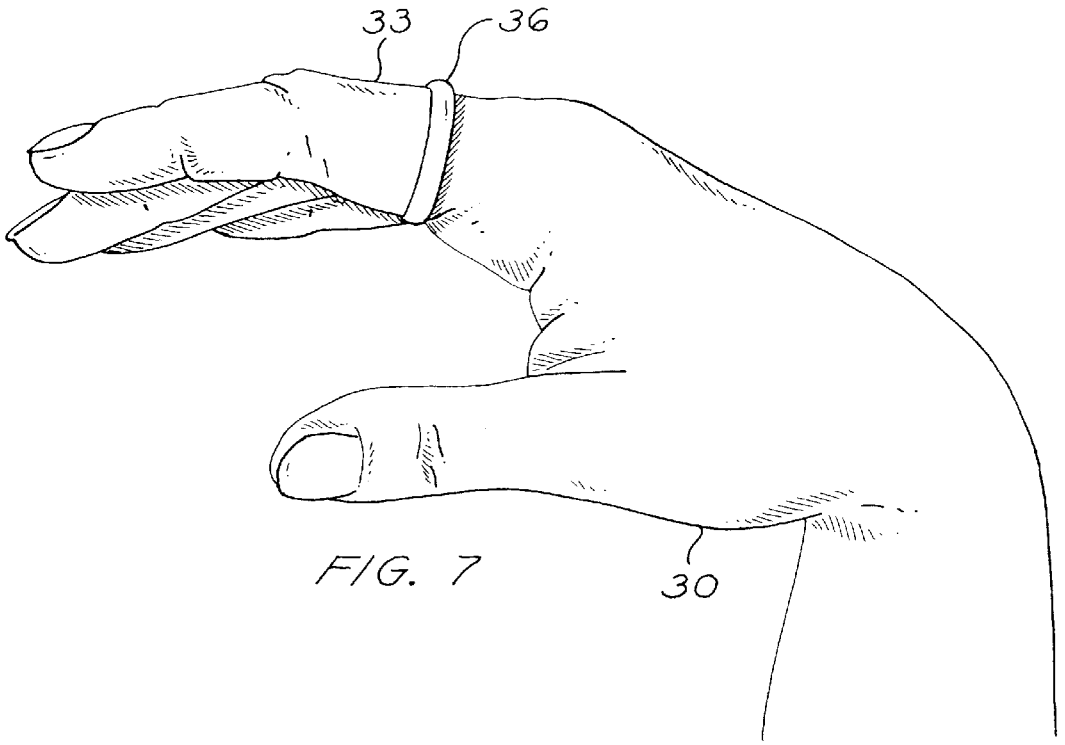
FIG. 7 is a side elevational view, illustrating a ring worn upon a finger.
Figure 8:
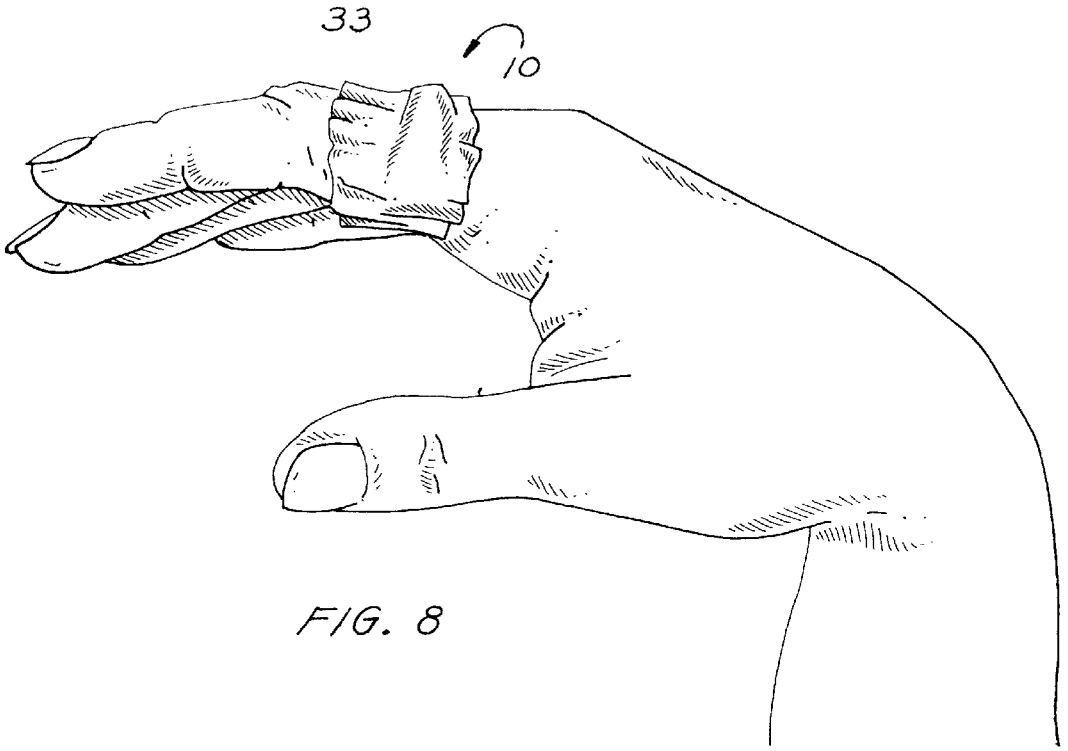
FIG. 8 is a side elevational view, similar to FIG. 7, except wherein the ring has been covered by the second embodiment of the invention.

With reference to FIG. 7, the hand 30 is illustrated, wherein a ring 36 is present on one of the fingers 33. In FIG. 8, the ring 36 has been covered with the second embodiment of the jewelry cover 10, wherein the jewelry cover 10 has been stretched around the finger 33, formed into a loop, which is then snugly secured on the finger 33 with the fastening device.

In conclusion, herein is disclosed a jewelry cover which is selectively attachable around a wrist or finger, to selectively cover jewelry with a decorative and protective covering to avoid harmful contact between the jewelry and other objects.

What is claimed is:

1. A jewelry covering method, for covering an article of jewelry present on a limb selected from a finger and a wrist, using a jewelry cover having a first end and a second end, an inside and an outside, and having a fastening device having a first fastener component located on the outside at the first end and a second fastener component located on the inside at the second end, comprising the steps of:

extending the jewelry cover around the limb and over the article of jewelry;

forming a loop with the jewelry cover by wrapping the jewelry cover around the limb until the first end overlaps the second end; and securing the first fastener component to the second fastener component.

2. The jewelry covering method as recited in claim 1 wherein the jewelry cover further has at least one elastic strip extending between the first end and second end on the inside, and wherein the step of wrapping the jewelry cover around the limb further comprises stretching the jewelry cover.

* * * * *